US008230646B2

(12) United States Patent
McDaniel

(10) Patent No.: US 8,230,646 B2
(45) Date of Patent: Jul. 31, 2012

(54) SLIDING DOOR ASSEMBLY ALLOWING FOR VARYING PERFORMANCE AND THRESHOLD HEIGHTS

(75) Inventor: Kyle A. McDaniel, Johns Creek, GA (US)

(73) Assignee: Alcoa Inc., Pittsburgh, PA (US)

( * ) Notice: Subject to any disclaimer, the term of this patent is extended or adjusted under 35 U.S.C. 154(b) by 405 days.

(21) Appl. No.: 12/366,046

(22) Filed: Feb. 5, 2009

(65) Prior Publication Data

US 2010/0192469 A1 Aug. 5, 2010

(51) Int. Cl.
*E06B 1/70* (2006.01)

(52) U.S. Cl. ..... 49/468; 49/467; 49/469; 49/505

(58) Field of Classification Search ..... 49/467, 49/468, 469, 470, 471; 52/209–212, 717.01, 52/718.01, 718.04
See application file for complete search history.

(56) References Cited

U.S. PATENT DOCUMENTS

| | | | | | |
|---|---|---|---|---|---|
| 582,451 | A | * | 5/1897 | Brannon | 49/471 |
| 1,787,523 | A | * | 1/1931 | Heinen | 49/470 |
| 2,108,137 | A | * | 2/1938 | Oftedal et al. | 49/471 |
| 2,851,744 | A | * | 9/1958 | Oehmig | 49/469 |
| 3,008,198 | A | * | 11/1961 | Grunwald | 49/467 |
| 3,273,287 | A | * | 9/1966 | Pease, Jr. | 49/468 |
| 3,475,866 | A | * | 11/1969 | Bergiton | 49/468 |
| 3,900,967 | A | * | 8/1975 | Bursk et al. | 49/468 |
| 3,967,412 | A | | 7/1976 | Governale | 49/468 |
| 4,055,917 | A | * | 11/1977 | Coller | 49/469 |
| 4,079,550 | A | * | 3/1978 | Bursk et al. | 49/467 |
| 4,287,684 | A | | 9/1981 | McKann | 49/468 |
| 4,310,991 | A | * | 1/1982 | Seely | 49/470 |
| 4,351,131 | A | * | 9/1982 | Kubik | 49/501 |
| 4,352,258 | A | | 10/1982 | Bursk et al. | 49/468 |
| 4,387,535 | A | | 6/1983 | Corbo | 49/468 |
| 4,411,104 | A | * | 10/1983 | St. Aubin | 49/470 |
| 4,441,277 | A | * | 4/1984 | Naylor | 49/380 |
| 4,525,966 | A | * | 7/1985 | Litchfield et al. | 52/204.591 |
| 4,565,033 | A | * | 1/1986 | Tinfow | 49/468 |
| 4,686,793 | A | * | 8/1987 | Mills | 49/471 |
| 4,831,779 | A | * | 5/1989 | Kehrli et al. | 49/471 |
| 4,888,924 | A | * | 12/1989 | Grisham et al. | 52/217 |
| 5,010,690 | A | | 4/1991 | Geoffrey | 49/469 |
| 5,067,279 | A | * | 11/1991 | Hagemeyer | 49/471 |
| 5,103,589 | A | * | 4/1992 | Crawford | 49/125 |
| 5,150,544 | A | * | 9/1992 | Burnett | 49/493.1 |
| 5,230,181 | A | | 7/1993 | Geoffrey et al. | 49/469 |
| 5,283,977 | A | * | 2/1994 | Smith | 49/380 |
| 5,596,851 | A | * | 1/1997 | Ting | 52/211 |
| 5,638,641 | A | | 6/1997 | Joffe et al. | 49/469 |
| 5,673,517 | A | * | 10/1997 | Stanclift | 49/468 |
| 6,052,949 | A | * | 4/2000 | Procton et al. | 49/506 |
| 6,125,599 | A | * | 10/2000 | Mees et al. | 52/204.5 |
| 6,138,413 | A | * | 10/2000 | Fehr | 49/382 |
| 6,289,635 | B1 | * | 9/2001 | Procton et al. | 49/467 |
| 6,308,475 | B1 | * | 10/2001 | Crish et al. | 52/204.597 |
| 6,789,358 | B2 | * | 9/2004 | Procton et al. | 49/471 |
| 7,150,130 | B2 | * | 12/2006 | Kobayashi et al. | 52/210 |
| 7,263,808 | B2 | | 9/2007 | Massey et al. | 52/204.21 |
| 7,941,982 | B2 | * | 5/2011 | Merica | 52/235 |

* cited by examiner

*Primary Examiner* — Katherine w Mitchell
*Assistant Examiner* — Marcus Menezes
(74) *Attorney, Agent, or Firm* — Greenberg Traurig, LLP

(57) ABSTRACT

A sliding door assembly allowing for varying performance and threshold heights is disclosed herein. A sliding door assembly incorporating a sliding door sill of the present invention can have varying performance and threshold heights while maintaining the integrity of the assembly. For example, the sliding doors do not have to be removed from the assembly, and the door frame does not have to be uninstalled.

10 Claims, 9 Drawing Sheets

SLIDING DOOR ASSEMBLY ALLOWING FOR VARYING PERFORMANCE AND THRESHOLD HEIGHTS

BACKGROUND

Sliding door assemblies typically include a sliding door moveable between a closed position and an open position, a stationary door maintained in a stationary position, and a door frame surrounding and supporting the sliding door and the stationary door. The door frame includes vertical jamb members, a head component, and a sill component. Existing designs do not allow for upgrades in performance levels, once the sliding door has been installed in the assembly, the water performance of the assembly is set.

SUMMARY

A sliding door assembly allowing for varying performance and threshold heights is disclosed herein. According to an embodiment of the present invention, there is disclosed a bottom sill component for a sliding door that includes a first sill component sufficiently designed to be capable of attaching with the sliding door and allowing lateral reciprocating motion of the sliding door; and a second sill component including a first securing means and a second securing means. The first securing means is sufficiently designed to: secure and maintain in place a weather bar or a first portion of a first base adaptor to the second sill component; allow for removal of the weather bar or the first portion of the first base adaptor from the second sill component without damaging the first securing means; and allow for re-securing and maintaining the weather bar or the first portion of the first base adaptor to the second sill component. The second securing means is sufficiently designed to: secure and maintain in place a first portion of a ramped saddle or a second portion of the first base adaptor to the second sill component; allow for removal of the first portion of the ramped saddle or the second portion of the first base adaptor from the second sill component without damaging the second securing means; and allow for re-securing and maintaining the first portion of the ramped saddle or the second portion of the first base adaptor to the second sill component.

According to an embodiment of the present invention, there is disclosed a bottom sill component for a sliding door that includes a first sill component sufficiently designed to be capable of attaching with the sliding door and allowing lateral reciprocating motion of the sliding door; and a second sill component including a first securing means and a second securing means. The first securing means is sufficiently designed to: secure and maintain in place a first portion of a performance adaptor to the second sill component; allow for removal of the first portion of the performance adaptor from the second sill component without damaging the first securing means; and allow for re-securing and maintaining the first portion of the performance adaptor to the second sill component. The second securing means is sufficiently designed to: secure and maintain in place a second portion of the performance adaptor to the second sill component; allow for removal of the second portion of the performance adaptor from the second sill component without damaging the second securing means; and allow for re-securing and maintaining the second portion of the performance adaptor to the second sill component.

According to an embodiment of the present invention, there is disclosed a sliding door assembly that includes a sliding door moveable between a closed position and an open position; a fixed-panel door maintained in a stationary position; and a bottom sill component having a first sill component and a second sill component. The first sill component is sufficiently designed to be capable of attaching with the sliding door and allowing lateral reciprocating motion of the sliding door. The second sill component includes a first portion and a second portion. The first portion attaches with the fixed-panel door and maintains the fixed-panel door in a stationary position, and the second portion includes a first securing means and a second securing means. The first securing means is sufficiently designed to: secure and maintain in place a weather bar, a first portion of a first base adaptor or a first portion of a performance adaptor to the second sill component; allow for removal of the weather bar, the first portion of the first base adaptor or the first portion of a performance adaptor from the second sill component without damaging the first securing means; and allow for re-securing and maintaining the weather bar, the first portion of the first base adaptor or the first portion of a performance adaptor to the second sill component. The second securing means it sufficiently designed to secure and maintain in place a first portion of a ramped saddle, a second portion of the first base adaptor or a second portion of the performance adaptor to the second sill component; allow for removal of the first portion of the ramped saddle, the second portion of the first base adaptor, or the second portion of the performance adaptor from the second sill component without damaging the second securing means; and allow for re-securing and maintaining the first portion of the ramped saddle, the second portion of the first base adaptor, or the second portion of the performance adaptor to the second sill component.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

Figure 1:
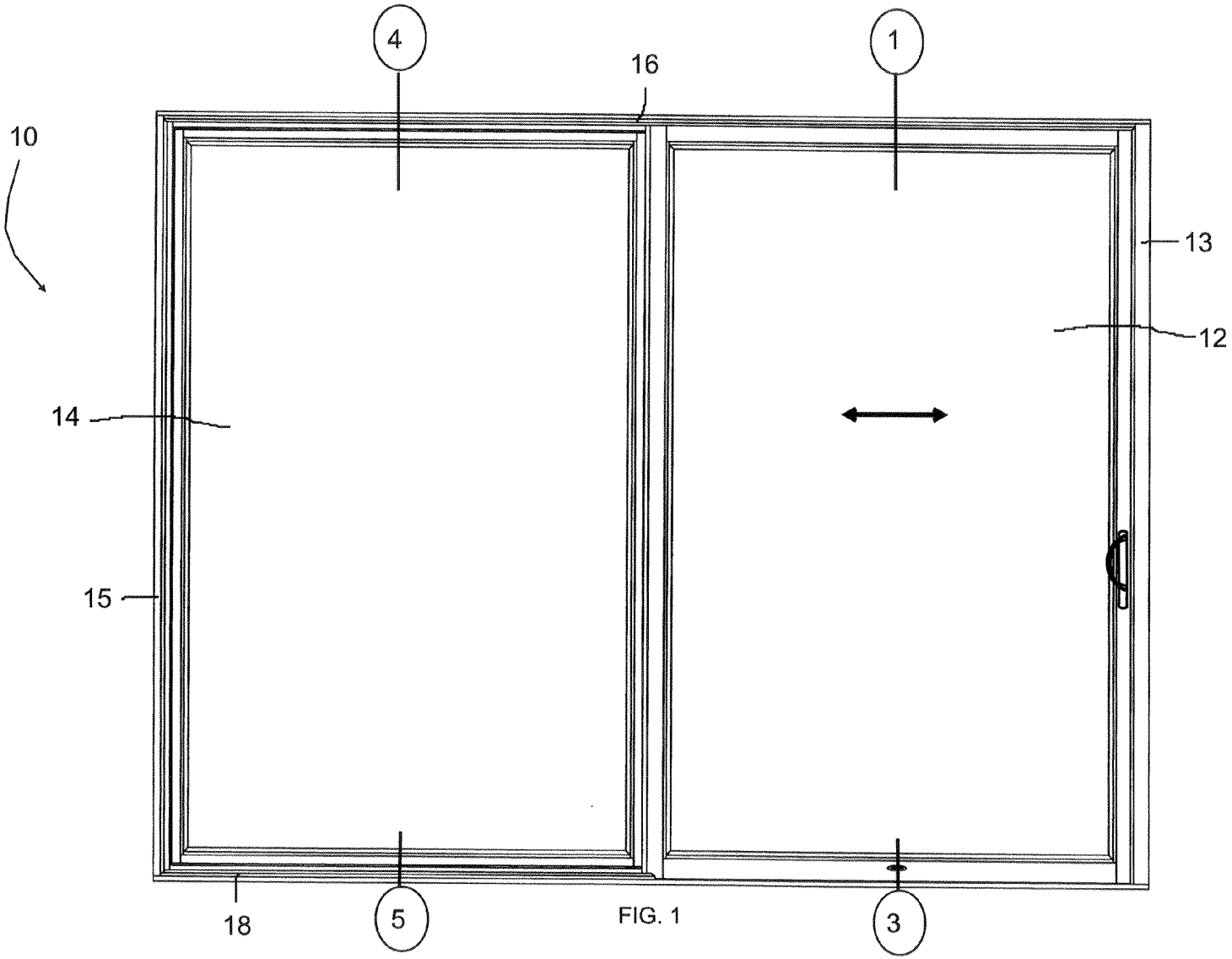
FIG. 1 is a front elevational view of an OX sliding door assembly incorporating components of the present invention.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

A sliding door assembly allowing for varying performance and threshold heights is disclosed herein. A sliding door assembly incorporating a sliding door sill of the present invention can have varying performance and threshold heights while maintaining the integrity of the assembly. For example, the sliding doors do not have to be removed from the assembly, the door frame does not have to be uninstalled, and no damage occurs to any of the components.

As used herein, the term "weather strip gasket" refers to a material or device used to prevent rain and water from entering a sliding door assembly by either blocking it outright or by blocking most of it and returning or rerouting it. A secondary goal of a weather-strip gasket may be to keep interior air in, thus saving energy with heating and air conditioning.

As used herein, the term "weather bar" refers to a device of the present invention used to help seal an opening. In an embodiment, the opening may exist between a threshold or sill and a door lock jamb. In an embodiment, the opening may exist between a threshold or sill and a fixed meeting stile. In an embodiment, the opening may exist between a head component and a door lock jamb. In an embodiment, the opening may exist between a head component and a fixed meeting stile. Weather bars of the present invention typically include one or more weather strip gaskets.

As used herein, the term "ramped saddle" refers to a threshold for a sliding door assembly of the present invention that has an angled top surface and meets ADA accessibility guidelines.

As used herein, the term "base adaptor" refers to a device that can be added or removed from a sill component or another base adaptor of a sliding door assembly of the present invention while a fixed-panel door and a sliding door of the sliding door assembly remain in place. In an embodiment, a base adaptor is added to a sill component for increasing the water performance of the sliding door assembly. In an embodiment, a base adaptor is used in conjunction with a ramped saddle to increase the water performance and to provide ADA accessibility.

As used herein, the term "performance adaptor" refers to a device that can be added to or removed from a sill component of a sliding door assembly of the present invention while a fixed-panel door and a sliding door of the sliding door assembly remain in place. In an embodiment, a performance adaptor is added to a sill component for increasing the water performance of the sill component. In an embodiment, a performance adaptor is used in conjunction with a flat threshold to increase the water performance of the sliding door assembly.

As used herein, the term "water and air infiltration" refers to the ability of water and/or air to move into an interior space.

As used herein, the term "engage", "engaging" or "engaged" refers to contacting or to make contact with something.

As used herein, the term "accessibility" means the degree to which a sliding door assembly allows access to people with disabilities.

As used herein, the term "Americans with Disabilities Act" or "ADA" means the civil rights law that prohibits, under certain circumstances, discrimination based on disability. Disability is defined as "a physical or mental impairment that substantially limits a major life activity." According to the current ADA Accessibility Guidelines, Section 4.13.8, Thresholds at Doorways, "Thresholds at doorways shall not exceed ¾ inch (19 mm) in height for exterior sliding doors . . . . Raised thresholds and floor level changes at accessible doorways shall be beveled with a slope no greater than 1:2."

FIG. 1 illustrates an embodiment of a sliding door assembly 10 incorporating components of the present invention. The sliding door assembly 10 includes a sliding door 12 moveable between a closed position and an open position, a vertical jamb member 13 capable of locking with the sliding door 12, a fixed-panel door 14 maintained in a stationary position, a vertical jamb member 15 for engaging the fixed-panel door 14, a head component 16 for attaching with upper portions of the sliding door 12 and the fixed-panel door 14, and a sill component 18 for attaching with lower portions of the sliding door 12 and the fixed-panel door 14. The sliding door assembly 10 of FIG. 1 has an OX configuration. It should be recognized that the components of the present invention can be used with sliding door assemblies having other unit configurations, including, but not limited to, an XO configuration, an OXO configuration, and an OXXO configuration. The components of the present invention are not intended to be limited to sliding door units having an OX configuration, as other typical sliding door configurations can be used.

Figure 2A:
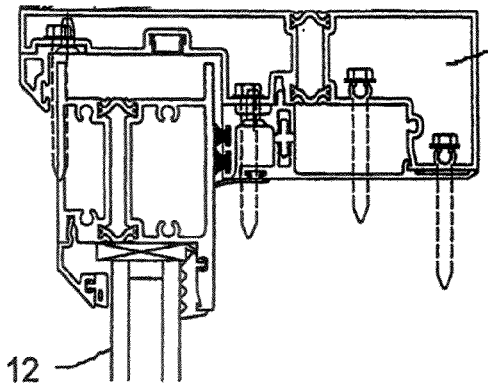
FIG. 2A is a cross-sectional view of a head component of the sliding door assembly of FIG. 1 taken generally along line 1.
Figure 2B:
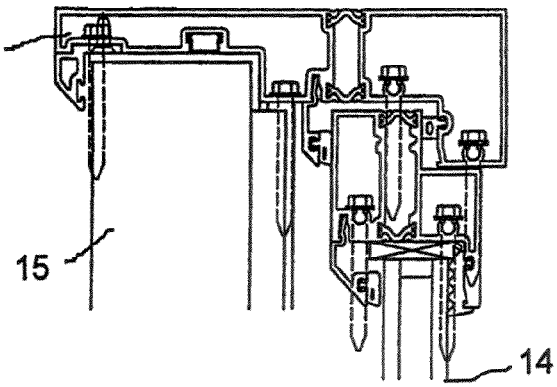
FIG. 2B is a cross-sectional view of a head component of the sliding door assembly of FIG. 1 taken along line 4.
Figure 2C:
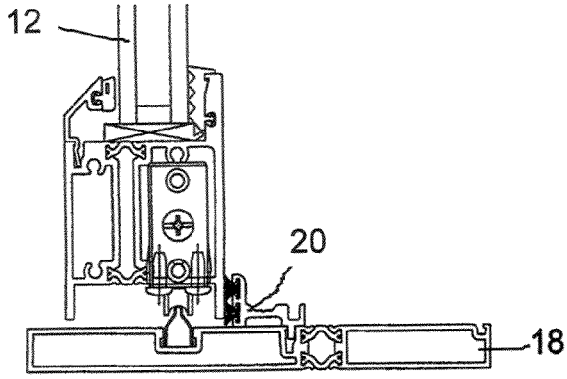
FIG. 2C is a cross-sectional view of an embodiment of a sill component of the sliding door assembly of FIG. 1 taken along line 3, wherein the sill component includes a weather bar.
Figure 2D:
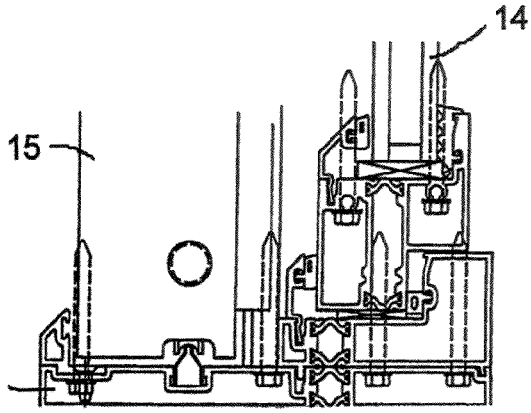
FIG. 2D is a cross-sectional view of a sill component of the sliding door assembly of FIG. 1 taken along line 5.

FIG. 2A shows a cross-sectional view of the head component 16 of the sliding door assembly 10 taken generally along line 1 of FIG. 1. FIG. 2B shows a cross-sectional view of the head component 16 of the sliding door assembly 10 taken generally along line 4 of FIG. 1. FIG. 2C shows a cross-sectional view of an embodiment of the sill component 18 of the sliding door assembly 10 taken along line 3 of FIG. 1, wherein the sill component 18 includes a weather bar. FIG. 2D shows a cross-sectional view of the sill component 18 of the sliding door assembly 10 taken along line 5 of FIG. 1.

Figure 3D:
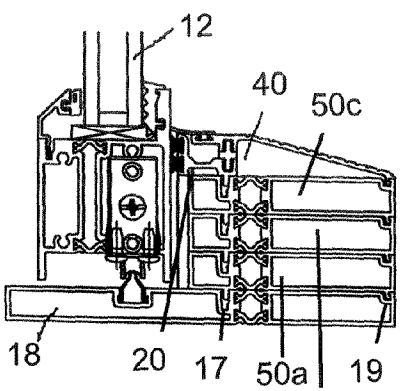
FIG. 3D shows a cross-sectional view of an embodiment of a sill component of the present invention for the sliding door assembly of FIG. 1 taken along line 3. The sill component includes three base adaptors, a weather bar, and a ramped saddle.
Figure 3C:
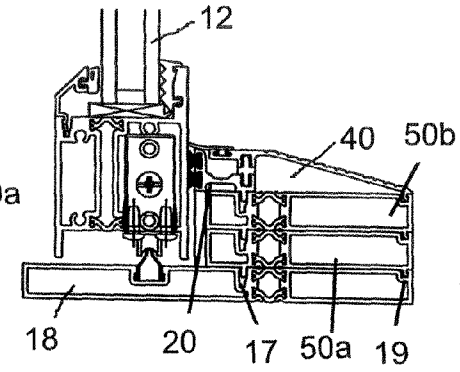
FIG. 3C shows a cross-sectional view of an embodiment of a sill component of the present invention for the sliding door assembly of FIG. 1 taken along line 3. The sill component includes two base adaptors, a weather bar, and a ramped saddle.
Figure 3B:
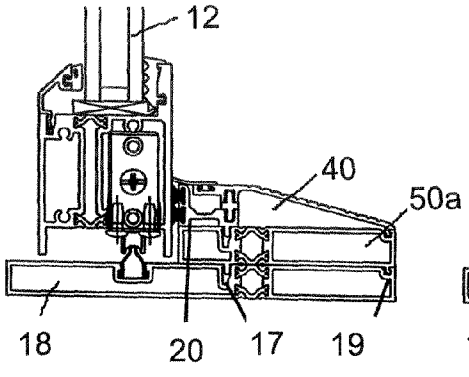
FIG. 3B shows a cross-sectional view of an embodiment of a sill component of the present invention for the sliding door assembly of FIG. 1 taken along line 3. The sill component includes a single base adaptor, a weather bar, and a ramped saddle.
Figure 3A:
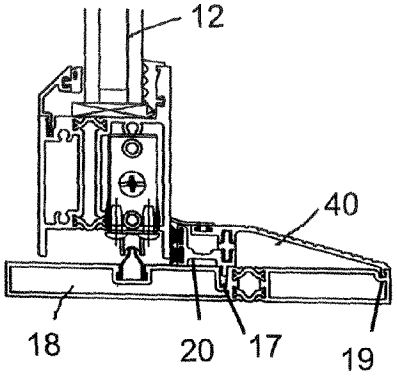
FIG. 3A shows a cross-sectional view of an embodiment of a sill component of the present invention for the sliding door assembly of FIG. 1 taken along line 3. The sill component includes a weather bar and a ramped saddle.
Figure 7:
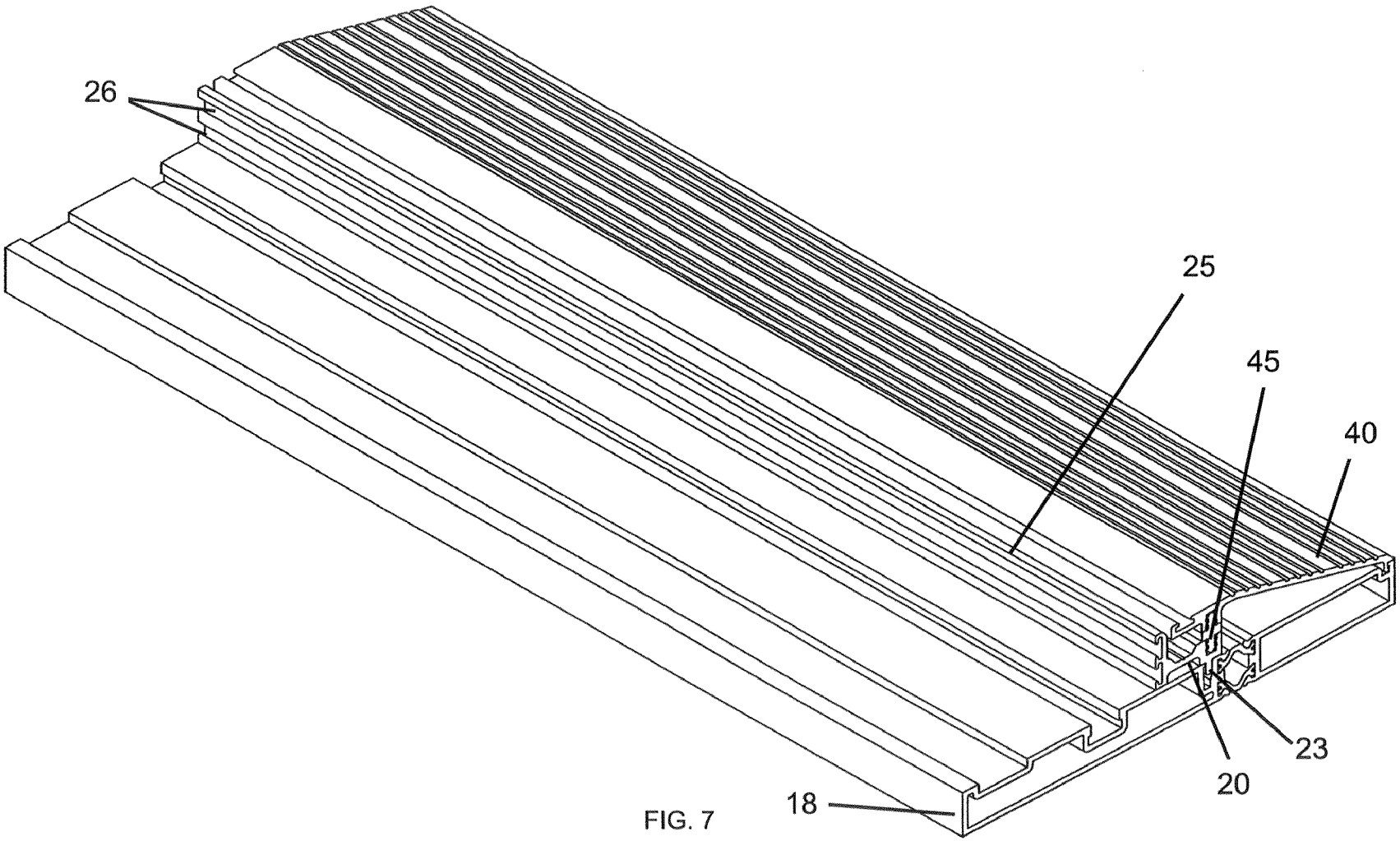
FIG. 7 is a fragmentary isometric view showing the sill component of FIG. 3A. The sill component illustrated in FIG. 7 is that portion extending between a door lock jamb member and a fixed meeting stile of the sliding door assembly of FIG. 1.

FIGS. 3A-3E show five different embodiments of the sill component 18 of the sliding door assembly 10 taken generally along line 3 of FIG. 1, wherein the sill component 18 includes various components of the present invention. FIG. 3A, in conjunction with FIG. 4 and FIG. 7, illustrate an embodiment of the sill component 18 of the present invention. The sill component 18 includes a first sill component 30 and a second sill component 35. The first sill component 30 is sufficiently designed to be capable of attaching with the sliding door 12 and allowing lateral reciprocating motion of the sliding door 12. The second sill component 35 includes a first securing means 17 and a second securing means 19. The first securing means 17 is sufficiently designed to secure and maintain in place a weather bar 20 to the second sill component 35. The weather bar 20 includes an attaching means 23 for engaging the first securing means 17 of the second sill component 35, and a horizontal member 25. The horizontal member 25 includes channels 26 for maintaining horizontal weather strip gaskets 27. The first securing means 17 is sufficiently designed to allow for removal of the weather bar 20 from the second sill component 35 without damaging the first securing means 17. The first securing means 17 is sufficiently designed to allow for re-securing and maintaining the weather bar 20 to the second sill component 35. The second securing means 19 is sufficiently designed to secure and maintain in place a first portion 42 of a ramped saddle 40 to the second sill component 35. The second securing means 19 is sufficiently designed to allow for removal of the first portion 42 of the ramped saddle 40 from the second sill component 35 without damaging the second securing means 19. The second securing means 19 is sufficiently designed to allow for re-securing and maintaining the first portion 42 of the ramped saddle 40 to the second sill component 35. The weather bar 20 and horizontal weather strip gaskets 27 are designed to substantially prevent water and air intrusion past the sliding door 12 when the sliding door 12 is in a closed position (as illustrated in FIG. 1). In an embodiment, the ramped saddle 40 indirectly engages the weather bar 20 via a thermal isolator or break 45. The thermal isolator 45 provides a separation between the exterior aluminum material of the ramped saddle 40 and the interior aluminum material of the weather bar 20.

Figure 5:
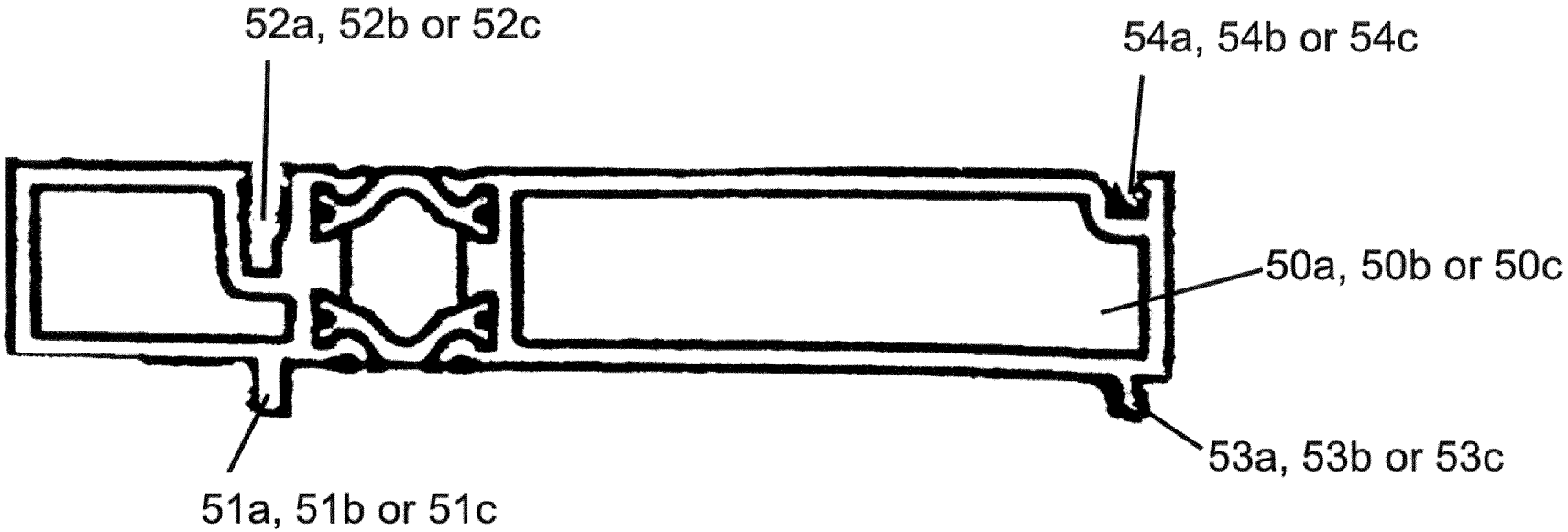
FIG. 5 shows an enlarged view of a base adaptor of the present invention. The base adaptor can be used with a sill component, as illustrated in FIGS. 3B-3D.
Figure 6:
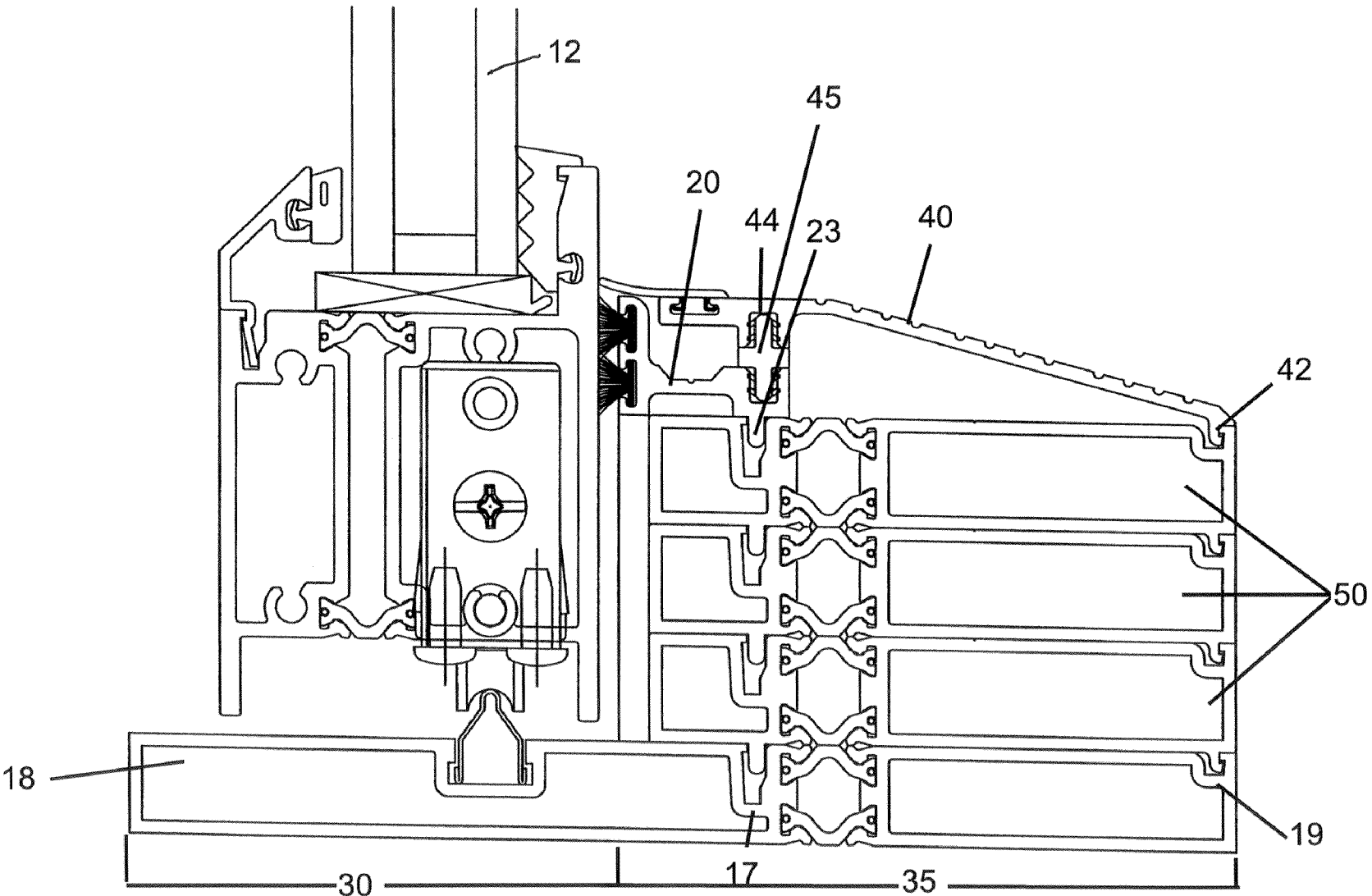
FIG. 6 shows an enlarged view of the sill component of FIG. 3D.

FIGS. 3B-3D, in conjunction with FIG. 5 and FIG. 6, illustrate other embodiments of the sill component 18 of the present invention. The sill component 18 includes a first sill component 30 and a second sill component 35. The first sill component 30 is sufficiently designed to be capable of attaching with the sliding door 12 and allowing lateral reciprocating motion of the sliding door 12. The second sill component 35 includes a first securing means 17 and a second securing means 19. As illustrated in FIG. 3B, in conjunction with FIG. 5, the first securing means 17 is sufficiently designed to secure and maintain in place a first portion 51*a* of a first base adaptor 50*a* to the second sill component 18. The first securing means 17 is sufficiently designed to allow for removal of the first portion 51*a* of the first base adaptor 50*a* without damaging the first securing means 17. The first securing means 17 is sufficiently designed to allow for re-securing and maintaining the first portion 51*a* of the first base adaptor 50*a* to the second sill component 35. The second securing means 19 is sufficiently designed to secure and maintain in place a second portion 53*a* of the first base adaptor 50*a* to the second sill component 35. The second securing means 19 is sufficiently designed to allow for removal of the second portion 53*a* of the first base adaptor 50*a* from the second sill component 35 without damaging the second securing means 19. The second securing means 19 is sufficiently designed to allow for re-securing and maintaining the second portion 53*a* of the first base adaptor 50*a* to the second sill component 35. The first base adaptor 50*a* further includes a first securing means 52*a* and a second securing means 54*a*. The first securing means 52*a* is sufficiently designed to secure and maintain in place an attaching means 23 of a weather bar 20 (see FIG. 3B) or a first portion 51*b* of a second base adaptor 50*b* (see FIG. 3C) to the first base adaptor 50*a*. The first securing means 52*a* is sufficiently designed to allow for removal of the weather bar 20 or the first portion 51*b* of the second base adaptor 50*b* without damaging the first securing means 52*a*. The first securing means 52*a* is sufficiently designed to allow for re-securing and maintaining the weather bar 20 of the first portion 51*b* of the second base adaptor 50*b*. The second securing means 54*a* is sufficiently designed to secure and maintain in place a first portion 42 of a ramped saddle 40 (See FIG. 3B) or a second portion 53*b* of the second base adaptor 50*b* (See FIG. 3C) to the first base adaptor 50*a*. The second securing means 54*a* is sufficiently designed to allow for removal of the first portion 42 of the ramped saddle 40 or the second portion 53*b* of the second base adaptor 50*b* without damaging the second securing means 54*a*. The second securing means 54*a* is sufficiently designed to allow for re-securing and maintaining the first portion 42 of the ramped saddle 40 or the second portion 53*b* of the second base adaptor 50*b*. The second base adaptor 50*b* further includes a first securing means 52*b* and a second securing means 54*b*. The first securing means 52*b* is sufficiently designed to secure and maintain in place a weather bar 20 (see FIG. 3C) or a first portion 51*c* of a third base adaptor 50*c* (see FIG. 3D) to the second base adaptor 50*b*. The first securing means 52*b* is sufficiently designed to allow for removal of the weather bar 20 or the first portion 51*c* of the third base adaptor 50*c* without damaging the first securing means 52*b*. The first securing means 52*b* is sufficiently designed to allow for re-securing and maintaining the weather bar 20 or the first portion 51*c* of the third base adaptor 50*c*. The second securing means 54*b* is sufficiently designed to secure and maintain in place a first portion 42 of a ramped saddle 40 (See FIG. 3C) or a second portion 53*c* of the third base adaptor 50*c* (see FIG. 3D) to the second base adaptor 50*b*. The second securing means 54*b* is sufficiently designed to allow for removal of the first portion 42 of the ramped saddle 40 or the second portion 53*c* of the third base adaptor 50*c* without damaging the second securing means 54*b*. The second securing means 54*b* is sufficiently designed to allow for re-securing and maintaining the first portion 42 of the ramped saddle 40 or the second portion 53*c* of the third base adaptor 50*b*. In an embodiment, the ramped saddle 40 indirectly engages the weather bar 20 via a thermal isolator or break 45. The thermal isolator 45 provides a separation between the exterior aluminum material of the ramped saddle 40 and the interior aluminum material of the weather bar 20.

Figure 3E:
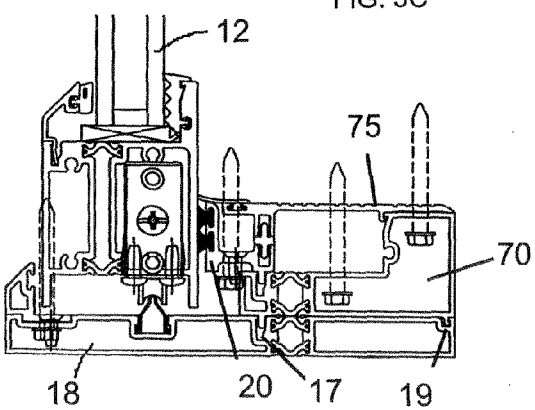
FIG. 3E shows a cross-sectional view of an embodiment of a sill component of the present invention for the sliding door assembly of FIG. 1 taken along line 3. The sill component includes a performance adaptor, a weather bar, and a flat saddle.
Figure 4:
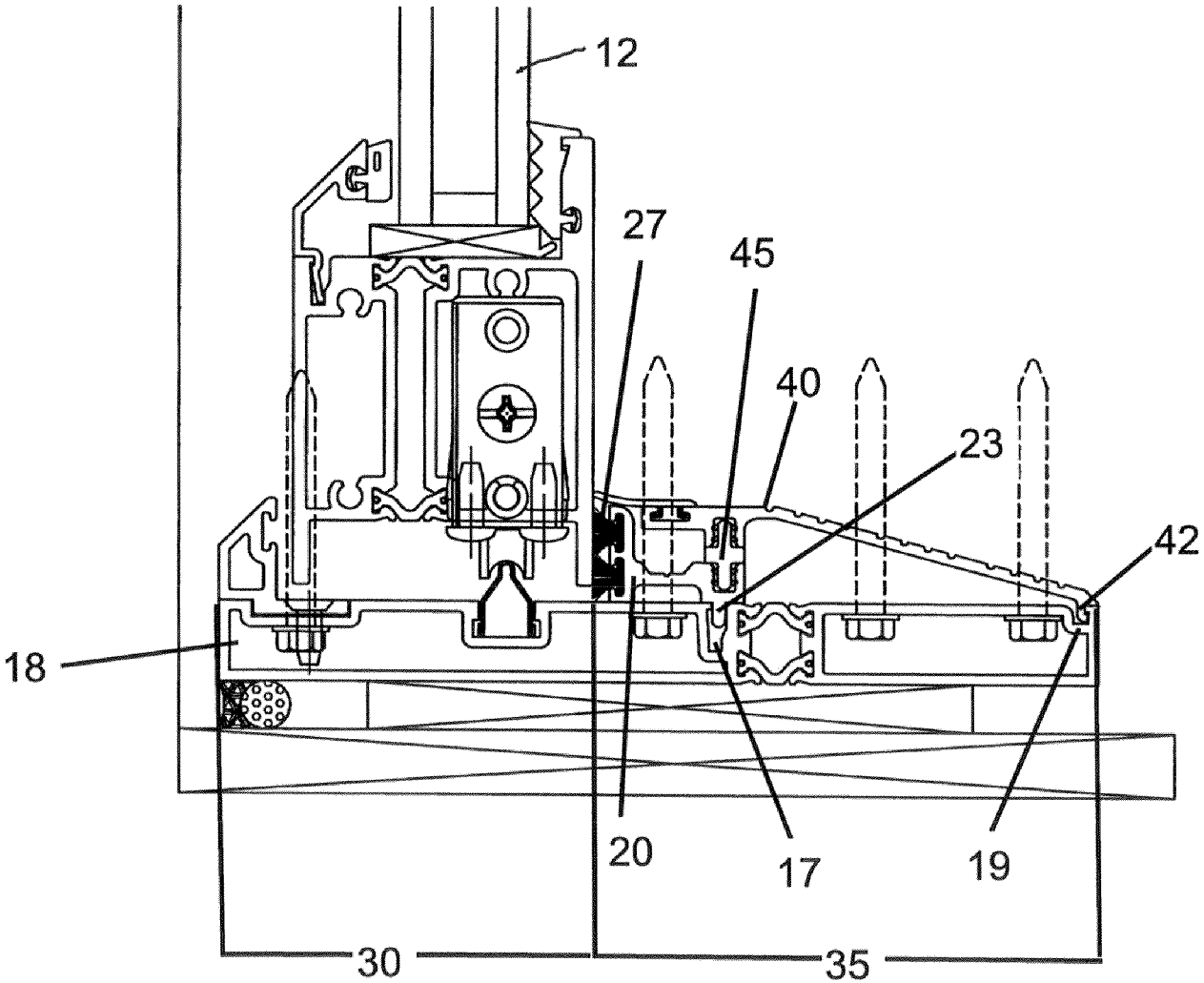
FIG. 4 shows an enlarged view of the sill component of FIG. 3A.
Figure 8:
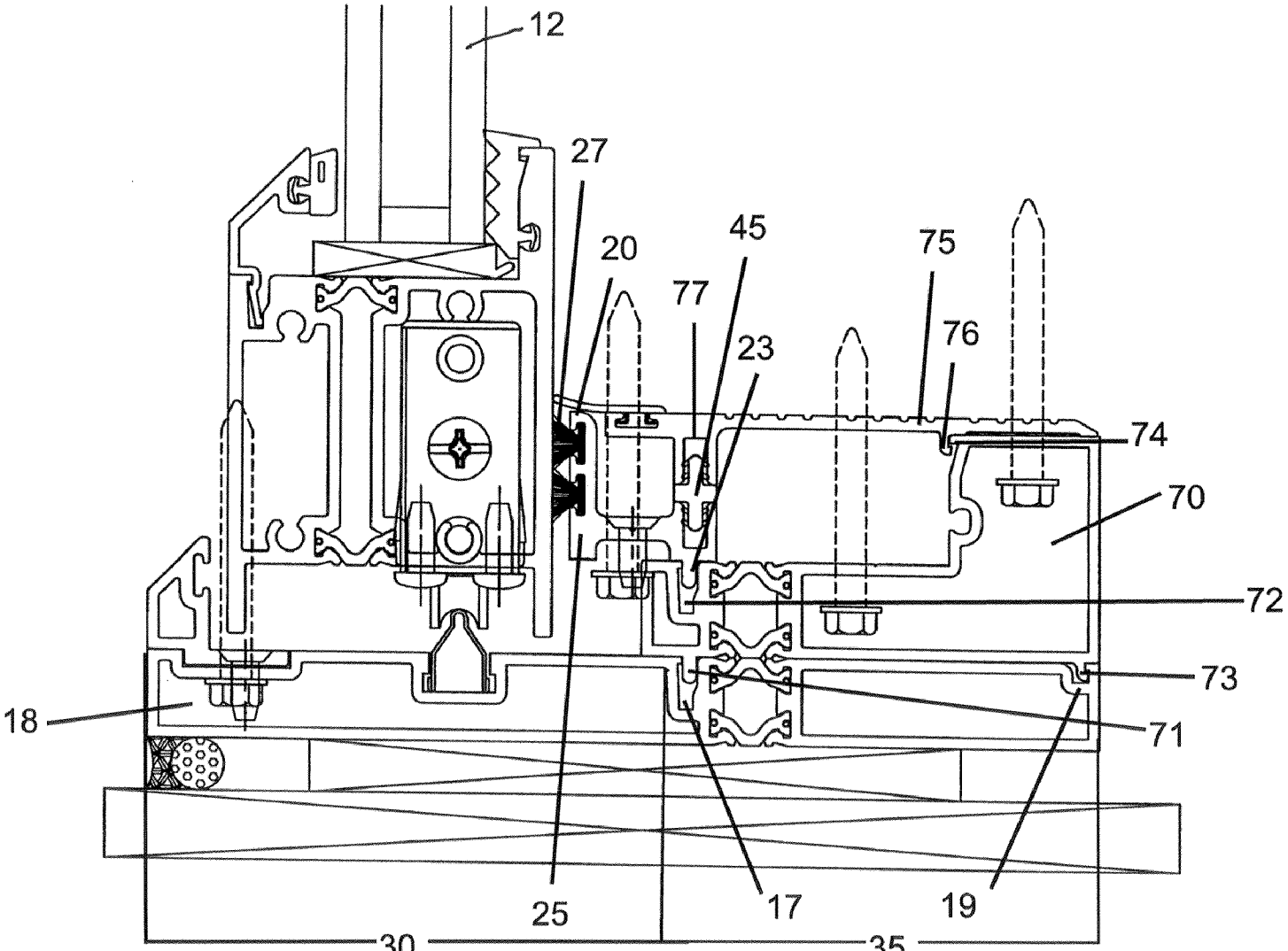
FIG. 8 shows an enlarged view of the sill component of FIG. 3E.
Figure 9:
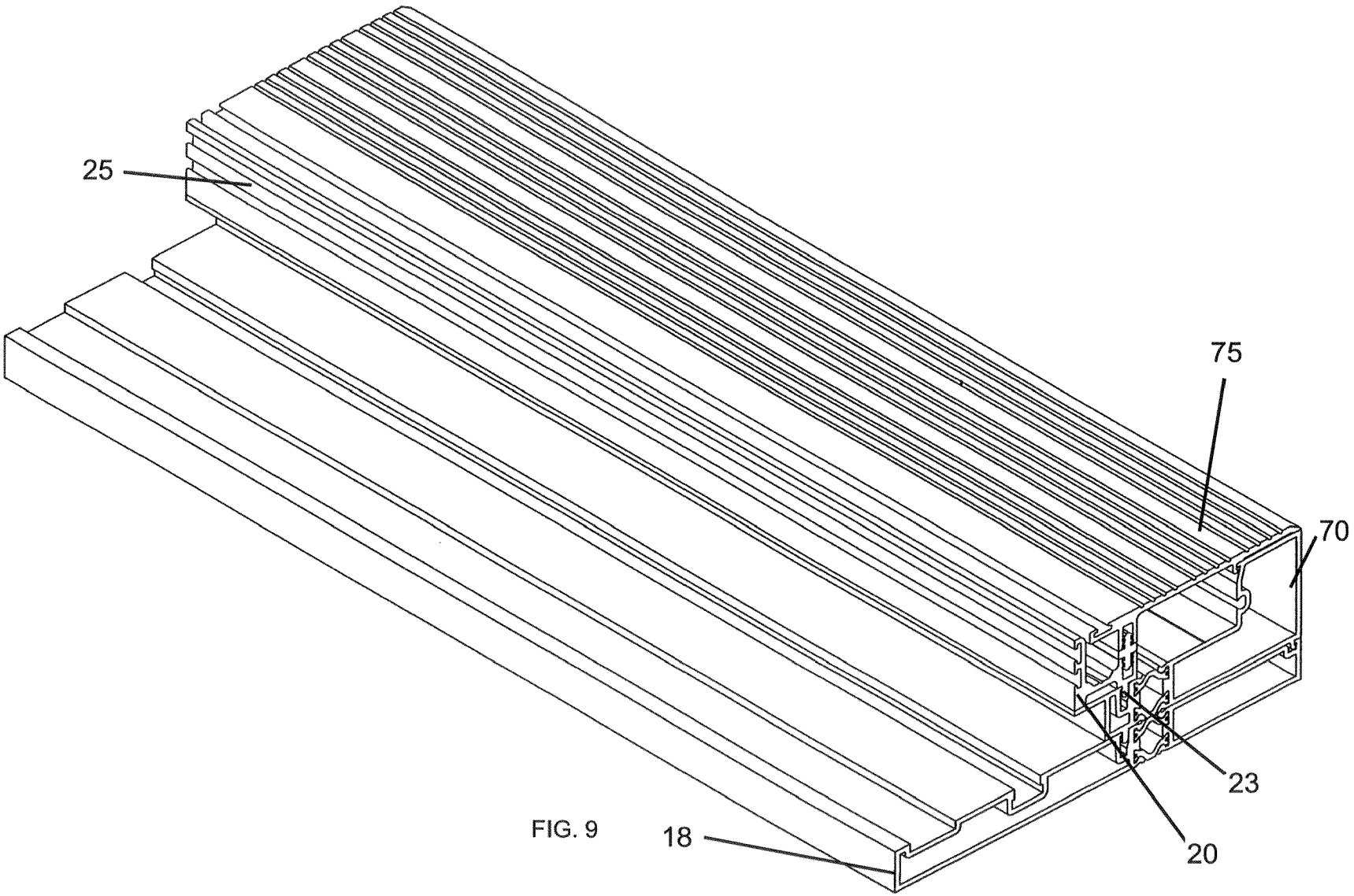
FIG. 9 is a fragmentary isometric view showing the sill component of FIG. 3E. The sill component illustrated in FIG. 9 is that portion extending between a door lock jamb member and a fixed meeting stile of the sliding door assembly of FIG. 1.

FIG. 3E, in conjunction with FIG. 8 and FIG. 9, illustrate an embodiment of the sill component 18 of the present invention. The sill component 18 includes a first sill component 30 and a second sill component 35. The first sill component 30 is sufficiently designed to be capable of attaching with the sliding door 12 and allowing lateral reciprocating motion of the sliding door 12. The second sill component 35 includes a first securing means 17 and a second securing means 19. The first securing means 17 is sufficiently designed to secure and maintain in place a first portion 71 of a performance adaptor 70 to the second sill component 35. The first securing means 17 is sufficiently designed to allow for removal of the first portion 71 of the performance adaptor 70 without damaging the first securing means 17. The first securing means 17 is sufficiently designed to allow for re-securing and maintaining the first portion 71 of the performance adaptor 70. The second securing means 19 is sufficiently designed to secure and maintain in place a second portion 73 of the performance adaptor 70. The second securing means 19 is sufficiently designed to allow for removal of the second portion 73 of the performance adaptor 70 without damaging the second securing means 19. The second securing means 19 is sufficiently designed to allow for re-securing and maintaining the second portion 73 of the performance adaptor 70. The performance adaptor 70 includes a first securing means 72 and a second securing means 74. The first securing means 72 is sufficiently designed to secure and maintain in place an attachment means 23 of a weather bar 20. The weather bar 20 includes the attaching means 23 for engaging the first securing means 72 of the performance adaptor 70, a horizontal member 25, and at least one horizontal weather strip gasket 27 engaging the horizontal member 25. The second securing means 74 is sufficiently designed to secure and maintain in place a first portion 76 of a substantially flat saddle 75. In an embodiment, a second portion 77 of the flat saddle 75 indirectly engages the weather bar 20 via a thermal isolator or break 45. The thermal isolator 45 provides a separation between the exterior aluminum material of the flat saddle 75 and the interior aluminum material of the weather bar 20. The flat saddle 75 is capable of substantially preventing water and air intrusion past the sliding door 12 when the sliding door 12 is in a closed position (as illustrated in FIG. 1).

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A bottom sill component for a sliding door comprising:

a first sill component capable of attaching with a sliding door and allowing lateral reciprocating motion of the sliding door;

a second sill component including a first securing means and a second securing means;

a first base adaptor positionable on top of the second sill component;

a second base adaptor positionable on top of the first base adaptor;

a weather bar that removably mates with the second base adaptor and is positionable on top of the second base adaptor; and a ramped saddle that removably mates with the second base adaptor, is positionable on top of the second base adaptor, and engages the weather bar, wherein the first securing means is capable of securing and maintaining in place a first portion of the first base adaptor to the second sill component, wherein the first securing means is capable of allowing removal of the first portion of the first base adaptor from the second sill component without damaging the first securing means, wherein the first securing means is capable of re-securing and maintaining the first portion of the first base adaptor to the second sill component, wherein the second securing means is capable of securing and maintaining in place a second portion of the first base adaptor to the second sill component, wherein the second securing means is capable of allowing removal of the second portion of the first base adaptor from the second sill component without damaging the second securing means, wherein the second securing means is capable of re-securing and maintaining the second portion of the first base adaptor to the second sill component, wherein a top surface of the first base adaptor removably mates with the second base adaptor so as to stack the second base adaptor on top of the first base adaptor, and wherein a top surface of the second base adaptor removably mates with the ramped saddle so as to stack the ramped saddle on top of the second base adaptor.

2. The bottom sill component of claim 1 wherein the weather bar substantially prevents water and air intrusion past the sliding door when the sliding door is in a closed position.

3. The bottom sill component of claim 1 wherein the weather bar comprises:

an attaching means for engaging the top surface of the second base adaptor;

a horizontal member; and at least one horizontal weather strip gasket engaging the horizontal member.

4. The bottom sill component of claim 1 wherein the second sill component includes a first portion and a second portion.

5. The bottom sill component of claim 4 wherein the second portion of the second sill component includes the first securing means and the second securing means.

6. The bottom sill component of claim 4 wherein the first portion of the second sill component is capable of attaching with a fixed-panel door so as to maintain the fixed-panel door in a stationary position.

7. The bottom sill component of claim 1 wherein the weather bar is designed to help seal an opening.

8. The bottom sill component of claim 1 wherein the ramped saddle indirectly engages the weather bar via a thermal isolator or break.

9. The bottom sill component of claim 1 wherein the second base adaptor is removable and has a substantially similar height and configuration as the first base adaptor.

10. The bottom sill component of claim 1 further comprising a third base adaptor.

* * * * *